US009237773B2

(12) United States Patent
Perlmutter

(10) Patent No.: US 9,237,773 B2
(45) Date of Patent: Jan. 19, 2016

(54) SELF-SECURING FOREARM GUARD

(71) Applicant: Samuel Ben Perlmutter, Cumberland, ME (US)

(72) Inventor: Samuel Ben Perlmutter, Cumberland, ME (US)

( * ) Notice: Subject to any disclaimer, the term of this patent is extended or adjusted under 35 U.S.C. 154(b) by 709 days.

(21) Appl. No.: 13/627,349

(22) Filed: Sep. 26, 2012

(65) Prior Publication Data

US 2014/0082811 A1 Mar. 27, 2014

(51) Int. Cl.

| | |
|---|---|
| ***A41D 13/08*** | (2006.01) |
| *A63B 71/12* | (2006.01) |
| *A63B 69/18* | (2006.01) |

(52) U.S. Cl.

CPC ..... *A41D 13/08* (2013.01); *A63B 69/18* (2013.01); *A63B 71/12* (2013.01); *A63B 2209/10* (2013.01)

(58) Field of Classification Search

CPC ..... A41D 13/08; A41D 13/088; A63B 71/12; A63B 2071/1258

See application file for complete search history.

(56) References Cited

U.S. PATENT DOCUMENTS

| | | | | | |
|---|---|---|---|---|---|
| 5,454,780 | A * | 10/1995 | Duback et al. | ..... | 602/8 |
| 5,456,658 | A * | 10/1995 | Duback et al. | ..... | 602/8 |
| 5,890,224 | A * | 4/1999 | Clark | ..... | 2/22 |
| 6,128,777 | A * | 10/2000 | Foreman | ..... | 2/16 |
| 7,694,348 | B1 * | 4/2010 | Smith | ..... | 2/16 |
| 2004/0163154 | A1 * | 8/2004 | Cooper | ..... | 2/69 |
| 2010/0319096 | A1 * | 12/2010 | Scott et al. | ..... | 2/16 |
| 2012/0090068 | A1 * | 4/2012 | Glass et al. | ..... | 2/22 |
| 2014/0259330 | A1 * | 9/2014 | Carbo et al. | ..... | 2/455 |

* cited by examiner

*Primary Examiner* — Shaun R Hurley
*Assistant Examiner* — Andrew W Sutton
(74) *Attorney, Agent, or Firm* — Bruce A. Lev

(57) ABSTRACT

A self-securing forearm guard used to protect a user's upper extremity during athletic training and competition. The current design incorporates heat moldable materials that allows an athlete to customize the guard's fit around their forearm using pressure applied by hand, and wherein the arm guard will retain the desired shape after the pressure is released, and thereby stay securely attached to said athlete's forearm without the need for straps and/or removable fasteners. The arm guard is adapted to protect a user's forearm during athletic activities such as skiing past and through ski gates, wherein it is common for a skier's forearm to intentionally contact the poles of such gates when skiing at a high rate of speed therethrough, thereby avoiding varying degrees of injury.

5 Claims, 6 Drawing Sheets

SELF-SECURING FOREARM GUARD

PRIORITY

This application claims priority to the Provisional Application 61/540,181 filed on Sep. 28, 2011.

FIELD OF INVENTION

This invention relates to forearm guards used within athletics such as ski racing, baseball, lacrosse and similar athletics when one wishes to protect their forearm from injury during athletic training and competition.

BACKGROUND OF THE INVENTION

Alpine ski racing, baseball, and contact sports such as lacrosse inherently involve intentional and accidental contact between an athlete's forearm and ski racing poles, baseballs, and lacrosse sticks, respectively.

In particular, Alpine ski racing has been a competitive sport for over 100 years. An essential part of competition requires a skier to ski between and through a series of racing gates at different points along the length of a ski course down the slope of a mountain. High speeds between 40 and 70 miles per hour are usually attained and intentional contact between the skier's forearm and the poles of the ski gates are common in order to be as close as possible to the gate thereby reducing the time it takes for the skier to reach the bottom and end of the race course. As such, a skier may sustain significant injury to their forearms after contacting one or many of the gates during one or more runs down the ski course. Therefore it became necessary to protect ski racers' forearms using a protective forearm guard.

Past and current attempts to guard a skier's forearm have included designs that used rigid panels secured to the skier's arms using straps with removable fasteners such as hook and loop, hook and catch, buckles, or Velcro. The down side of these forearm guard designs are numerous. For one, the usual size and shape sold in stores rarely fit securely and comfortably around each individual skier. In addition, during ski racing and contact with the poles of the gates, some of the straps would come loose and the guard would become insecure. Furthermore, it can be difficult and time consuming to apply and remove each guard to each arm since usually can only be done with one hand as the other is inaccessible due to the position that the arm and hand is in while trying to attach the guard. Finally, securing the guard to the forearm with removable fasteners requires removing one's ski glove to place the guard on the contralateral forearm making this task difficult in arctic cold weather.

Therefore, it is in the athlete's benefit to have a design to overcome these deficiencies.

SUMMARY OF THE INVENTION

The current invention incorporates a heat moldable thermoplastic polymer material and provides a new and unique design to protect an athlete's forearm during training and competition. The device is provided and preformed to the athlete's arm in multiple sizes. When heated by means of an oven, warm water, or a hair dryer, the near circumferential device becomes moldable and remoldable, and the athlete may provide a custom fit of the device by simply providing pressure applied by hand, and wherein the device will retain the desired shape after the device cools.

Once cooled, the elasto-plastic properties of the polymer material allows the athlete to pull apart the device wide enough device to slide the device on and off of the forearm. When slid onto the forearm in a lengthwise fashion, the shape memory of the polymer material allows the device to recoil thereby firmly securing the device to the forearm, thereby keeping the guard from moving and sliding off of the athlete's arm, even during contact. The device material may be chosen from a wide variety of thermoplastic polymers including thermoplastic polyester.

It is an object of this invention to provide an improved protective extremity guard for athletes and the like.

Another object of this invention is to provide a custom fit of the device achievable by the athlete for protection of the extremity.

A further object of this invention is to allow a simple technique of placement of this protective device using the gloved hand without needing the use of an additional fastener.

Finally, another object of invention is to provide near circumferential protection of the forearm given the design of the device.

DESCRIPTION OF THE PREFERRED EMBODIMENT

Figure 1:
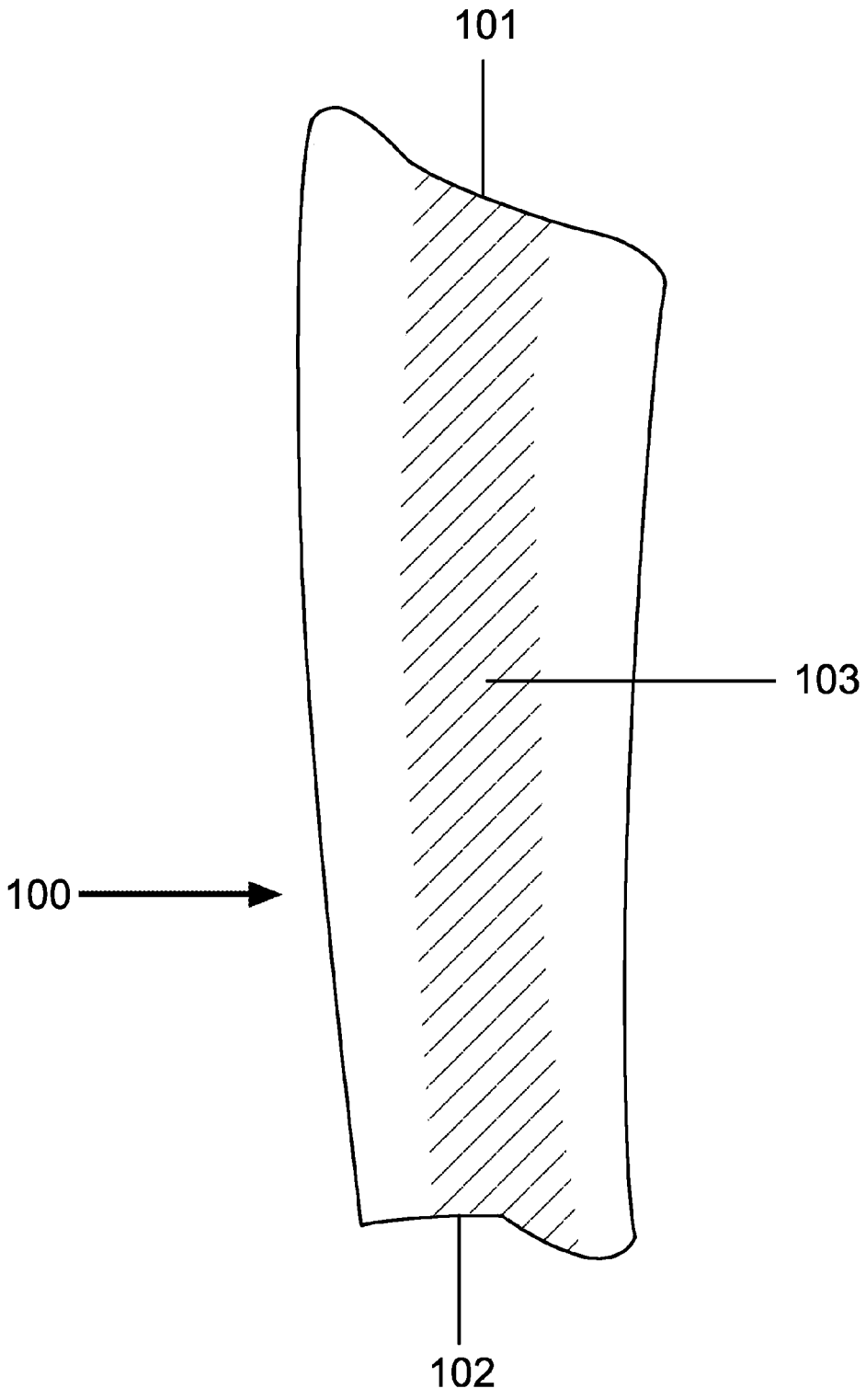
FIG. 1 is a dorsal view of the protective guard.

Referring to FIG. 1, numeral 100 designates a protective forearm guard of the present invention, which is particularly suitable for use by alpine ski racers and protect their forearm from injury when racing and striking ski gate poles at high speeds. Protective guard 100 is formed as an elongated panel member having a length defining a primary axis, and being curved producing a circumferential cross section around said primary axis, and can be formed from an elasto-plastic polymer material, such as polyethylene. Protective gear 100 includes proximal open end 101 being sized to fit around the proximal forearm and distal open end 102 being sized to fit around the wrist of the athlete. The guard has a varied thickness around its circumference with the thickest portion located on the dorsal (outer) surface 103 in order to offer the most protection and ability to absorb impact when striking a ski gate pole. The thicker dorsal portion of the guard is smooth and firm as to avoid deformity when striking the ski gate thereby minimizing speed reduction of the ski racer as the racer passes the ski gate. The asymmetric shape of the guard allows maximum protection of the forearm with the freedom of fully flexing and extending the elbow and wrist.

Figure 2:
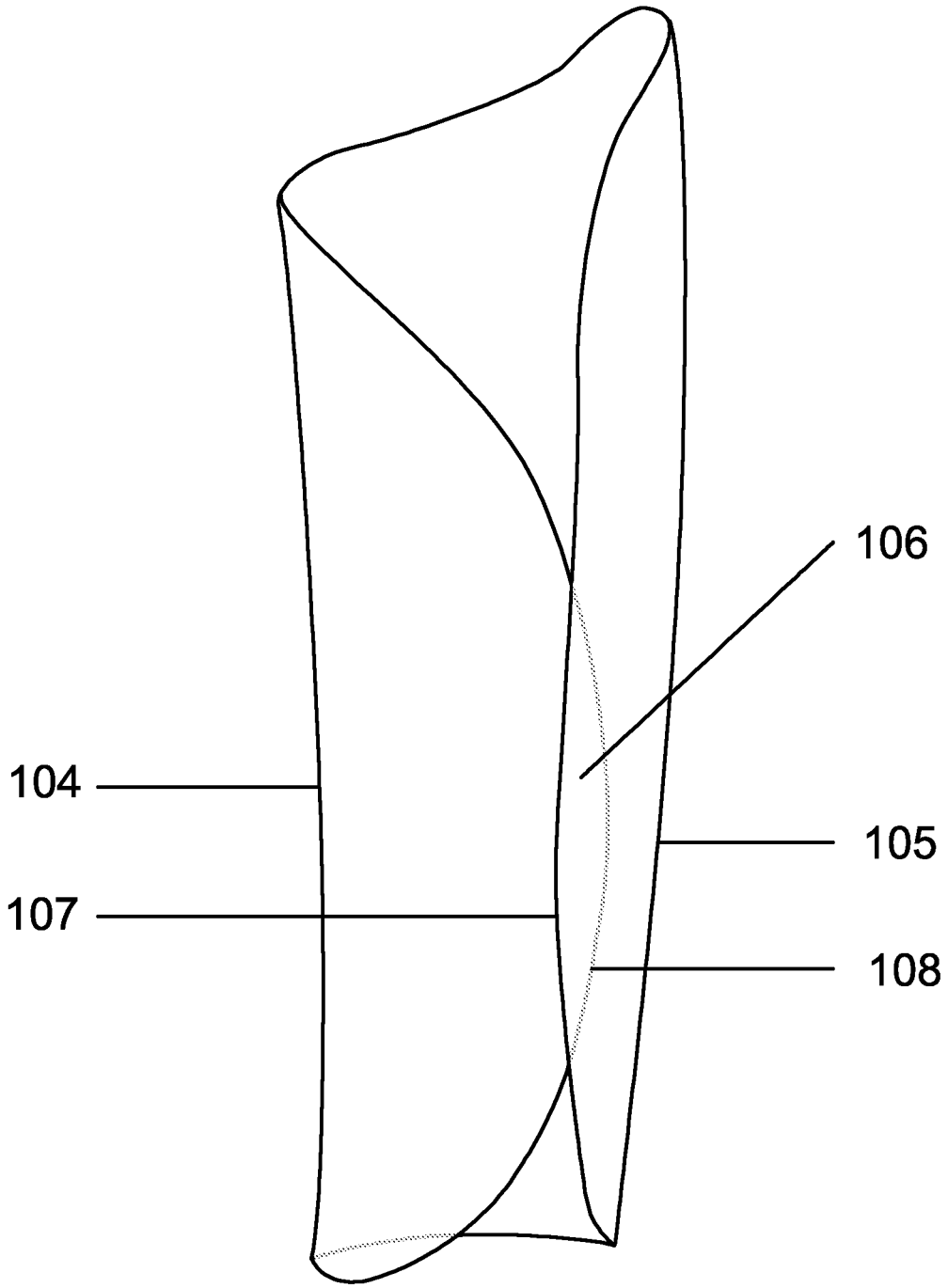
FIG. 2 is a ventral view of the protective guard.

As best seen in FIG. 2, numeral 104 depicts the ventral medial aspect of the protective guard with numeral 105 depicting the ventral lateral portion of the guard. The guard overlap 106 allows for a secure fit after opening the two edges 107 and 108 of the guard manually and slipping the guard over the longitudinal axis of the forearm. Once placed, the guards elasto-plastic design recoils allowing for a firm and secure fit of the guard over the forearm especially after custom forming it to the forearm. The guard is molded to the muscloskeletal shape of the individual ski racer providing a custom secure fit.

Figure 3:
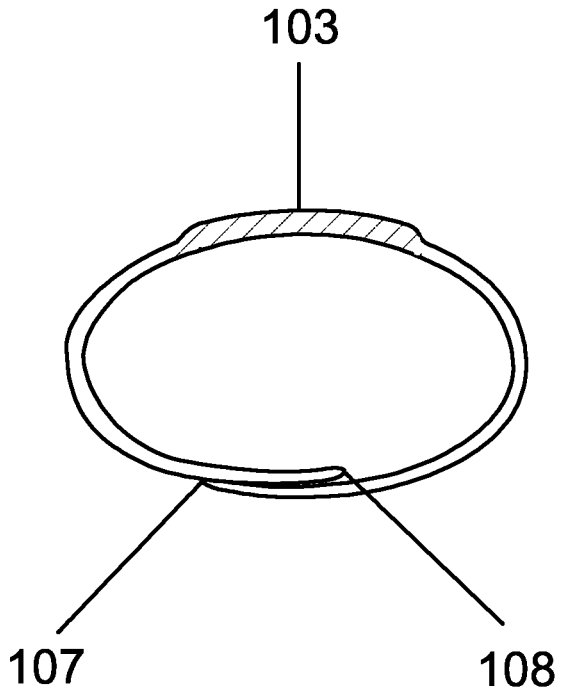
FIG. 3 is a cross sectional view of the protective guard.

Referring to FIG. 3, the thickened dorsal surface 103, shown in cross section, offers maximum protection when striking the ski gate. This thickened surface transitions to the remaining forearm guard shell gently whereas the remaining thickness of the forearm guard is consistent and thinner. The overlap 106 of the two ventral surfaces of the guard 107,108 provide a secure strapless fit.

Figure 4:
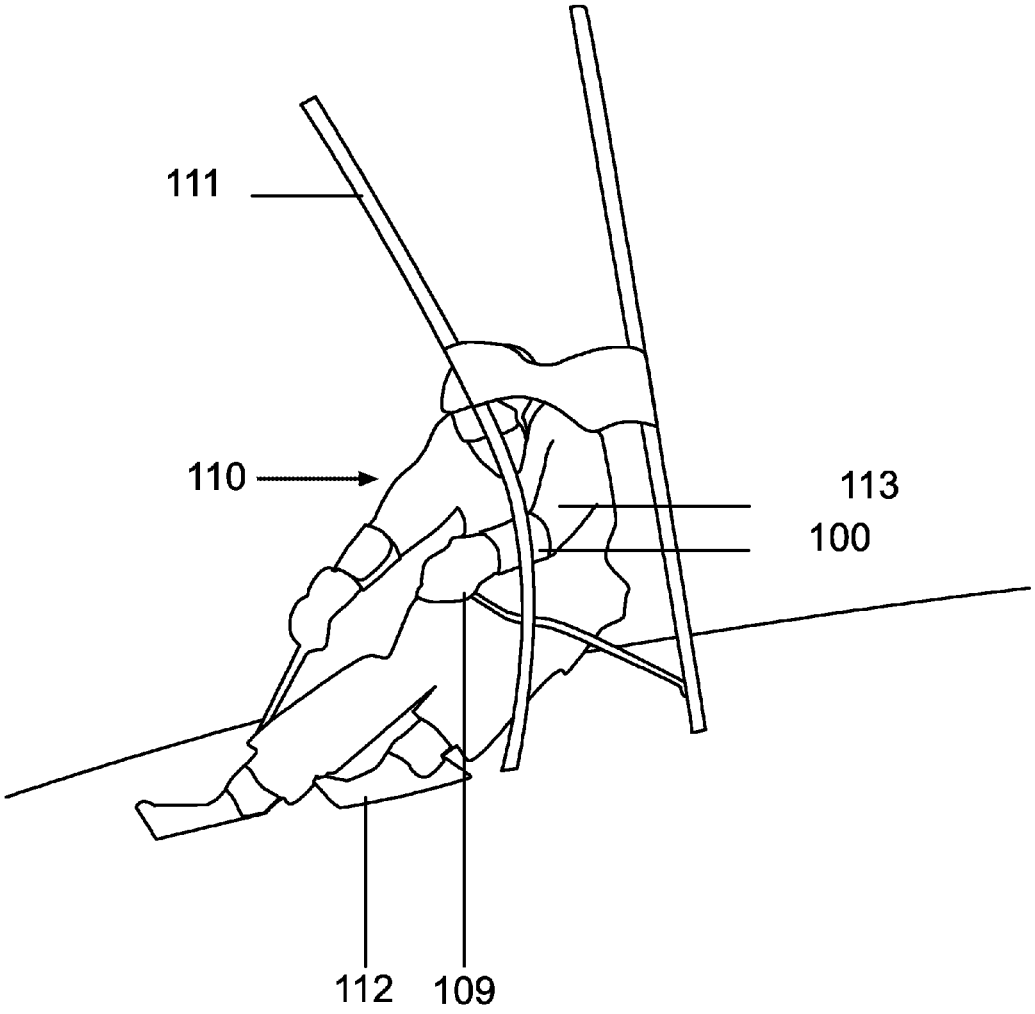
FIG. 4 is a perspective view of an alpine ski racer using the protective guard in accordance with this invention.

The forearm guard 100 is positioned on the skier's forearm as shown in FIG. 4. The forearm guard extends from the gloved hand/wrist 109 of the skier to the proximal forearm just below the elbow crease. As the ski racer 110 navigates the ski gate 111 while racing downhill, it is the ski races desire to allow his body to be as close to the gate as possible in order to minimize the time it takes to complete the race. As a result the preferred ski racing technique is to lead with the hand and forearm as the downhill ski 112 passes the ski gate. This technique often requires striking the ski gate with the downhill upper extremity 113 resulting in contact of the dorsal outer surface of the forearm guard 100 and the ski gate 111. As the ski gate is made of a flexible plastic material this action causes the ski gate to deform as seen in FIG. 4.

Figure 5:
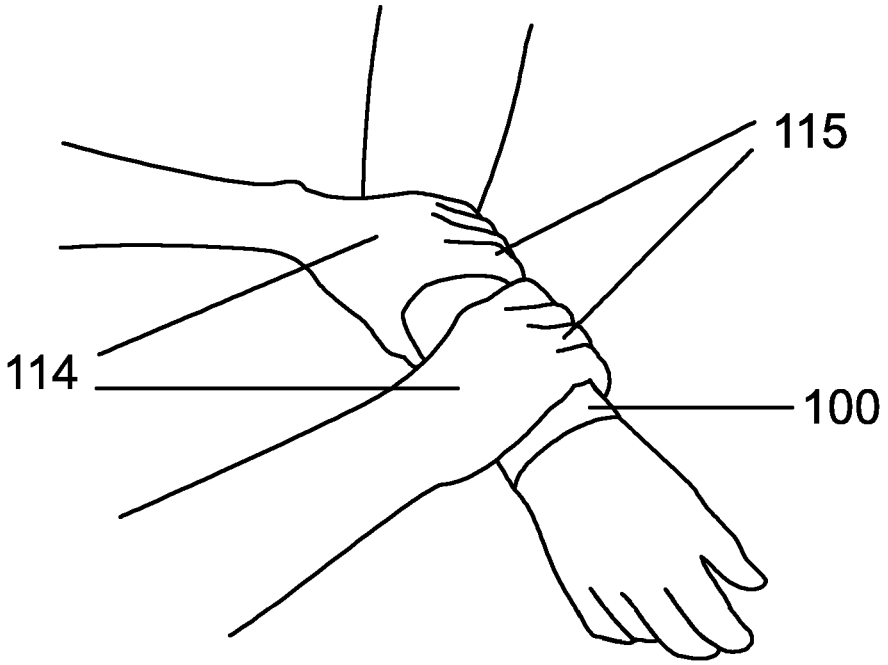
FIG. 5 is a perspective view of digital pressure being applied to the protective guard in order to custom mold the device to the forearm.
Figure 6:
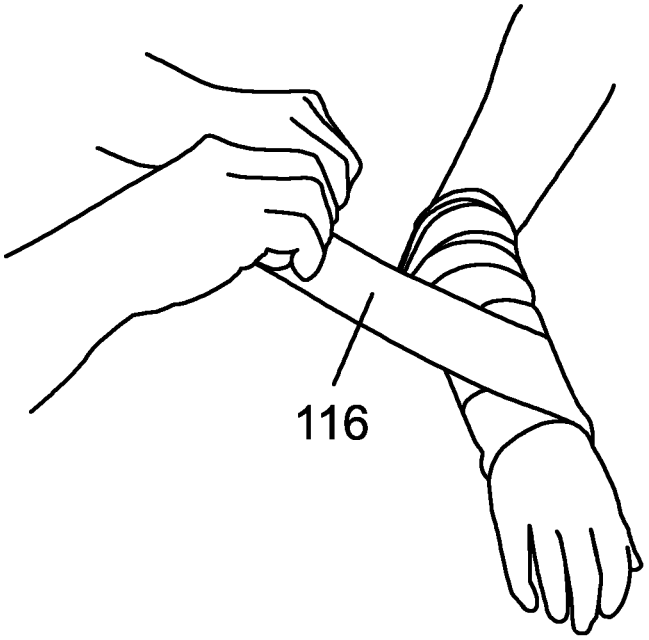
FIG. 6 is a perspective view of an elastic band wrapped around the protective guard in order to custom mold the device to the forearm.

After heating the forearm guard, by means of warm water, an oven, and/or a hair dryer, the guard is pliable and can be custom molded around the forearm. As seen in FIG. 5 this is initially accomplished with digital pressure of an assistant's hand 114 and fingers 115. Then, while still warm and pliable, FIG. 6 depicts the device being overlapped and wrapped by the assistant with an elastic bandage 116 in order to provide uniform compression and molding of the device to the forearm. Hardening of the device will conclude within several minutes as the device cools to body temperature and then will retain the shape to which it was formed. Reforming the forearm protector may take place by simply heating the device once again as noted.

A custom moldable self-securing forearm guard is described above. While the protective device described above as for use as a ski racing forearm guard it can also be used for other athletic purposes that require protection of one's forearm such as lacrosse, hockey, and baseball. In addition potential use of the described guard may have applications in the workplace in those who desire forearm protection during employment tasks. Various details of the invention may be changed without departing from its spirit or scope. Furthermore, the above description and illustrations shall be interpreted as illustrative and not for the purpose of limitation.

The preferred embodiment allows for a ski racer to place a guard over their forearm in a self-securing manner without the need for straps, buckles, or Velcro, thereby allowing the skier to avoid removing their ski glove during placement and removal of the guard.

Another embodiment incorporates moldable heatable material that an athlete, with assistance, can form the guard around their forearm by using pressure applied by hand and/or elastic band, and wherein the guard will retain the desired custom shape after pressure is released and the device cools. This provides a custom fit for protection and stability when striking ski race gates at a high speed.

The forearm guard does not necessarily need to completely encompass the forearm, but still can attach in a near circumferential manner.

The curved cross sectional design and material plasticity allows for easy placement and removal by simply pulling the edges of the guard wide enough apart as to allow it to slip over the longitudinal axis of the forearm and recoil when released providing fit stability and forearm protection.

In an additional embodiment, a moldable plastic material is utilized an adapted to be heated and cooled to increase the moldability and stiffness of the device, respectively, in order to increase the security of fit and protection of the forearm guard.

What is claimed:

1. A method of providing and applying a forearm guard to a person's forearm, said method comprising the following steps:

a; providing a forearm guard comprising an elongated panel member having a length defining a primary axis, a proximal end, and a distal end opposite from said proximal end, opposite side edges, and being curved producing a circumferential cross section around said primary axis, such that said forearm guard is adapted to be placed upon and extend a length of a person's forearm; said forearm guard being formed from a moldable material having material properties such that said person can apply and form the arm guard around their forearm by using pressure applied by hand, wherein said forearm guard will retain the desired shape after said pressure is released, and thereby stay securely attached to said person's forearm; and wherein said moldable material is an elasto-plastic material; and an elastic bandage that is adapted to be wrapped around said forearm guard when said forearm guard is in place and compressed around a person's arm, to thereby hold said forearm guard in the desired position until said material retains its shape, and is adapted to be removed once said forearm guard retains its shape in place around said person's forearm;

b; heating said forearm guard to a temperature that softens said elasto-plastic material enough so said person can manipulate it around their forearm such that said proximal end is near their elbow and said distal end is near their wrist;

c; compressing said guard around said person's forearm until in the desired position;

d; wrapping said elastic bandage around said forearm guard to thereby hold said forearm guard in the desired position around said person's forearm until said material cools down, hardens, and retains its shape;

e; removing said elastic bandage from said forearm guard;

f; wearing said forearm guard;

g; removing said forearm guard by using pressure and bending said panel member to thereby allow said forearm guard to be removed from said person's forearm;

h; reusing said forearm guard by repeating steps b through e.

2. The method of providing and applying a forearm guard to a person's forearm of claim 1, wherein said elongated panel includes an outer surface portion that extends along said length thereof and for a predetermined distance of said circumference; said outer surface portion having a thickness that is greater than the thickness of the rest of said elongated panel, and is thereby adapted to be less flexible than the rest of said elongated panel, and offer more protection to the person's arm.

3. The method of providing and applying a forearm guard to a person's forearm of claim 1, wherein said side edges are curved in order to reduce the possibility of scratching the person's arm or pinching the person's arm between the two side edges when applying thereon.

4. The method of providing and applying a forearm guard to a person's forearm of claim 1, wherein said side edges are adapted to overlap one another when fully secured to a person's arm.

5. The method of providing and applying a forearm guard to a person's forearm of claim 1, wherein said forearm guard is formed from a thermoplastic polymer of elasto-plastic material.

* * * * *